US005193565A

United States Patent [19]

Huang

[11] Patent Number: 5,193,565

[45] Date of Patent: Mar. 16, 1993

[54] RIB LINKAGE JOINT

[75] Inventor: Sheng F. Huang, Taipei, Taiwan

[73] Assignee: 'totes', incorporated, Cincinnati, Ohio

[21] Appl. No.: 699,751

[22] Filed: May 14, 1991

[30] Foreign Application Priority Data

Jun. 19, 1990 [CN] China ..... 90209047

[51] Int. Cl.[5] ..... A45B 19/00

[52] U.S. Cl. ..... 135/25.2; 135/25.3; 135/29; 135/31

[58] Field of Search ..... 135/25.2, 25.3, 25.31-25.34, 135/26, 29, 31

[56] References Cited

U.S. PATENT DOCUMENTS

| | | | |
|---|---|---|---|
| 1,577,227 | 3/1926 | Greenwald | 135/252.2 |
| 4,627,455 | 12/1986 | Okuda et al. . | |
| 4,676,262 | 6/1987 | Yang . | |
| 4,739,783 | 4/1988 | Yang . | |
| 4,766,917 | 8/1988 | Yang . | |
| 4,934,395 | 6/1990 | Wu | 135/25.3 |
| 4,966,180 | 10/1990 | Lai | 135/25.3 |

FOREIGN PATENT DOCUMENTS

| | | | |
|---|---|---|---|
| 0181977 | 5/1986 | European Pat. Off. | 135/25.3 |
| 712820 | 10/1941 | Fed. Rep. of Germany . | |
| 2234939 | 1/1974 | Fed. Rep. of Germany . | |
| 2254714 | 5/1974 | Fed. Rep. of Germany | 135/25.3 |
| 2030856 | 4/1980 | United Kingdom . | |
| 2151135 | 7/1985 | United Kingdom | 135/25.3 |

*Primary Examiner*—David A. Scherbel
*Assistant Examiner*—Lan M. Mai
*Attorney, Agent, or Firm*—Wood, Herron & Evans

[57] ABSTRACT

An improved rib linkage joint for an umbrella where the rib linkage includes an inner rib and an inner linking spoke, both hingedly connected to a middle joint, that middle joint being fixed to one end of a middle rib. The inner rib, the inner linking spoke and the middle joint is each in the form of a strut having a U-shaped cross section with the slots thereof facing upward. A flexible middle linking spoke has one end hooked on a pin fixed between the strut side walls of the inner linking spoke adjacent the middle joint. This structure allows easier assembly of the rib linkage joint initially, as well as enhances compactness of the rib linkage when the umbrella is collapsed.

1 Claim, 5 Drawing Sheets

RIB LINKAGE JOINT

This invention relates to umbrellas. More particularly, this invention relates to rib linkage joints for umbrellas.

In the rib linkage for one type of umbrella, as shown in FIGS. 5 and 6, one end of an inner rib A and one end of an inner linking spoke B are hingedly connected to a middle joint C, and the other ends of the inner rib A and the inner linking spoke B are hingedly connected to the umbrella's crown and an inner support rib E, respectively. The inner rib A passes through a bifurcated end of the inner support rib E, the central portion of which is pivoted therewith. An outer end of the inner linking spoke B is connected with a flexible middle linking spoke D. The inner rib A and the inner linking spoke B of the prior art rib linkage is each U-shaped in cross-section with the slots thereof facing downward. This contrasts with the slot of the U-shaped middle joint C which faces upward.

When the prior art umbrella is opened, i.e., when the rib linkage is extended as shown in FIG. 5, the inner linking spoke B is positioned adjacent the inner rib A and the middle joint C is supposed to seat partially in the slot of the inner linking spoke B. But the middle joint does not always seat smoothly in the slot of the inner linkage slot B because the inner rib A and the inner linking spoke B are not connected to the same point of the middle joint C, and when this situation occurs, the opening can be adversely affected. In addition, the inner linking spoke B is connected to the flexible middle linking spoke D (as shown in FIGS. 5 and 6 on the top surface of the inner linking spoke B through use of a hole in the top surface of that inner linking spoke B and a hook at the end of the flexible middle linking spoke D. In this structure, the flexible middle linking spoke D cannot be seated in the slot of the inner linking spoke B when the rib linkage is collapsed, and this is counter to the desire of a compact rib linkage when the umbrella is closed. Also, the manufacture and assembly of a rib linkage joint with inner rib A and a flexible middle linking spoke D is more difficult than is desired, and may provide an umbrella of lesser quality than desired.

Accordingly, the primary objective of this invention is to provide an improved rib linkage for an umbrella comprising an inner rib, a middle joint and an inner linking spoke, all of which are U-shaped in cross section with slots thereof facing upward, and a flexible inner linking spoke having one end connected to a pin fixed between side walls of the inner linking spoke so that the flexible middle linking spoke can be at least partially seated into the slot of the inner linking spoke, thus enhancing the ease of assembly of the rib linkage joint and enhancing the compactness of the umbrella when the rib linkage is collapsed.

Another objective of this invention is to provide an improved rib linkage joint for an umbrella comprising an inner rib, a middle joint and an inner linking spoke, all of which are U-shaped in cross section with slots thereof facing upward, and a flexible middle linking spoke having one end connected to a pin fixed between side walls of the inner linking spoke, these components being structured so that when the rib linkage is opened the lower edge of the inner linking spoke is guided by the middle joint into seated relation with the inner rib.

Other objectives and advantages of this invention will be more apparent from the following detailed description in connection with the accompanying drawings in which.

Figure 5:
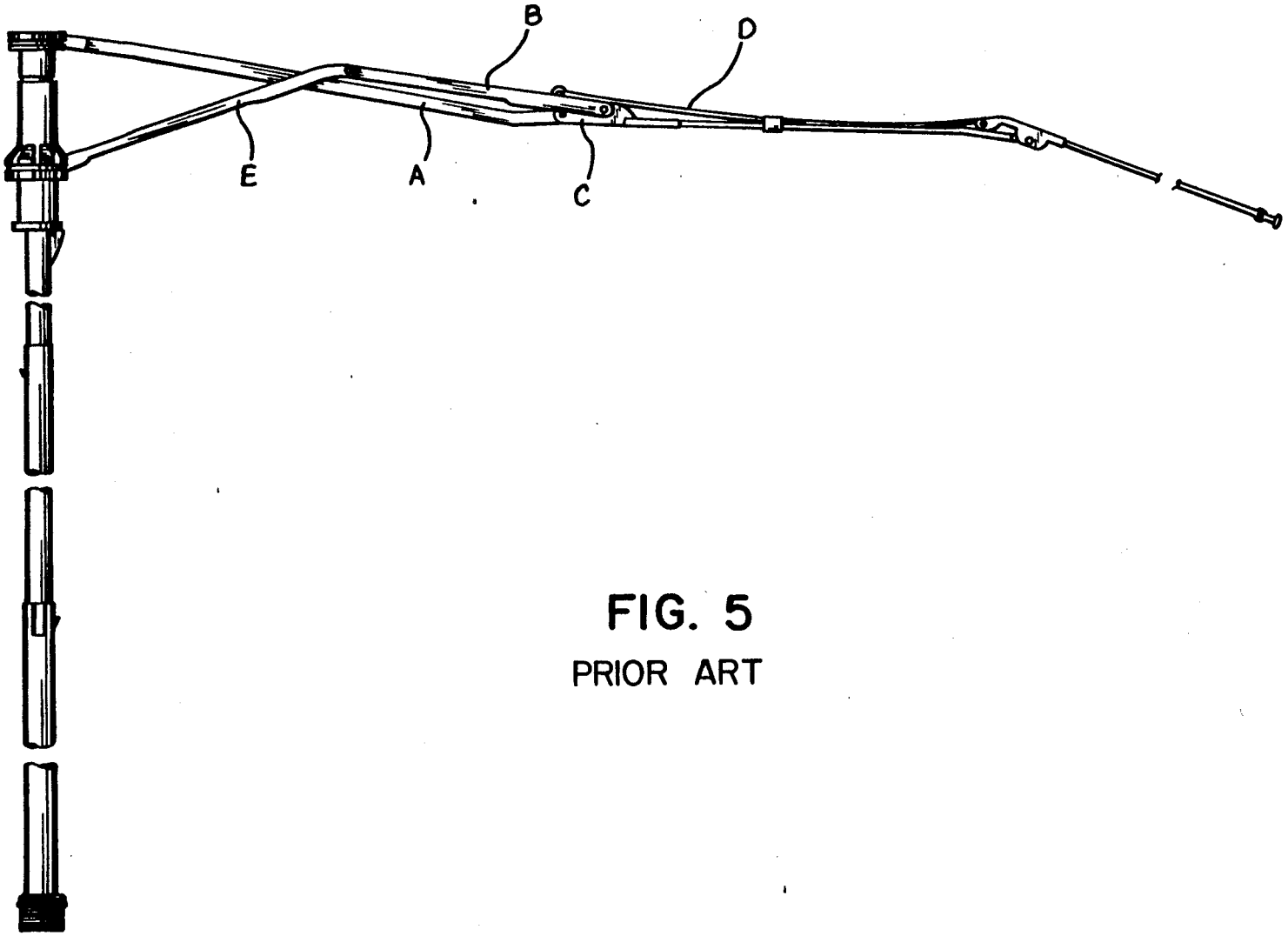
FIG. 5 PRIOR ART
FIG. 5 is a plan view similar to FIG. 1 but showing a conventional umbrella rib linkage.
Figure 6:
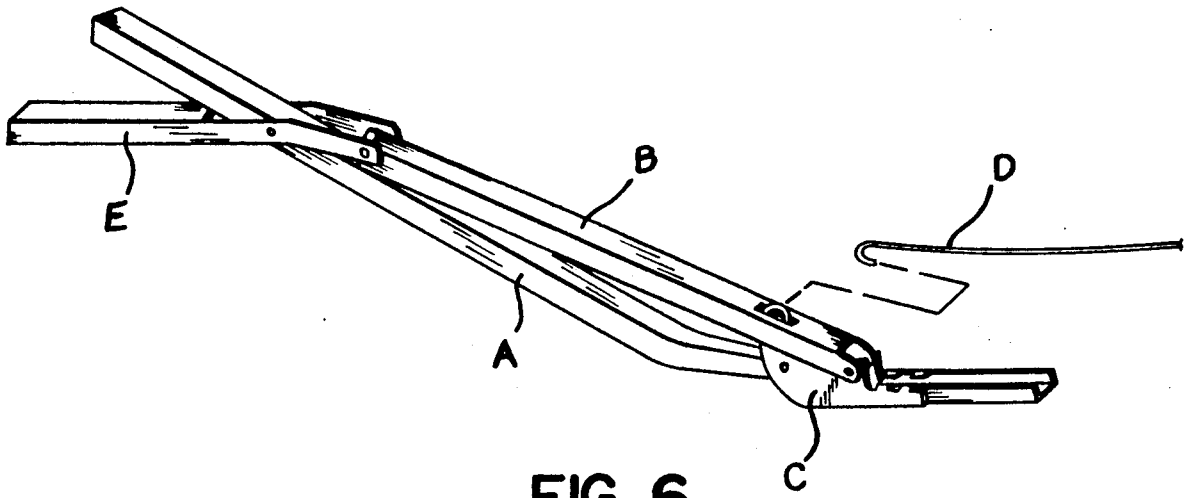
FIG. 6 PRIOR ART
FIG. 6 is an enlarged exploded view similar to FIG. 2 showing the conventional umbrella of FIG. 5.

This invention is directed to an umbrella 100, as shown in FIGS. 1–4, comprised of a crown 10, a runner 20, an inner rib 30, an inner support rib 40, an inner linking spoke 50, a middle joint 60, an outer joint 61, a middle rib 70, a flexible middle linking spoke 71, an outer rib 80, and a fixing sleeve 90. This invention constitutes an improvement over a conventional prior art umbrella, as shown in FIGS. 5 and 6, comprised of an inner rib A, an inner linking spoke B, a middle joint C, a flexible middle linking spoke D, and an inner support rib E.

Figure 1:
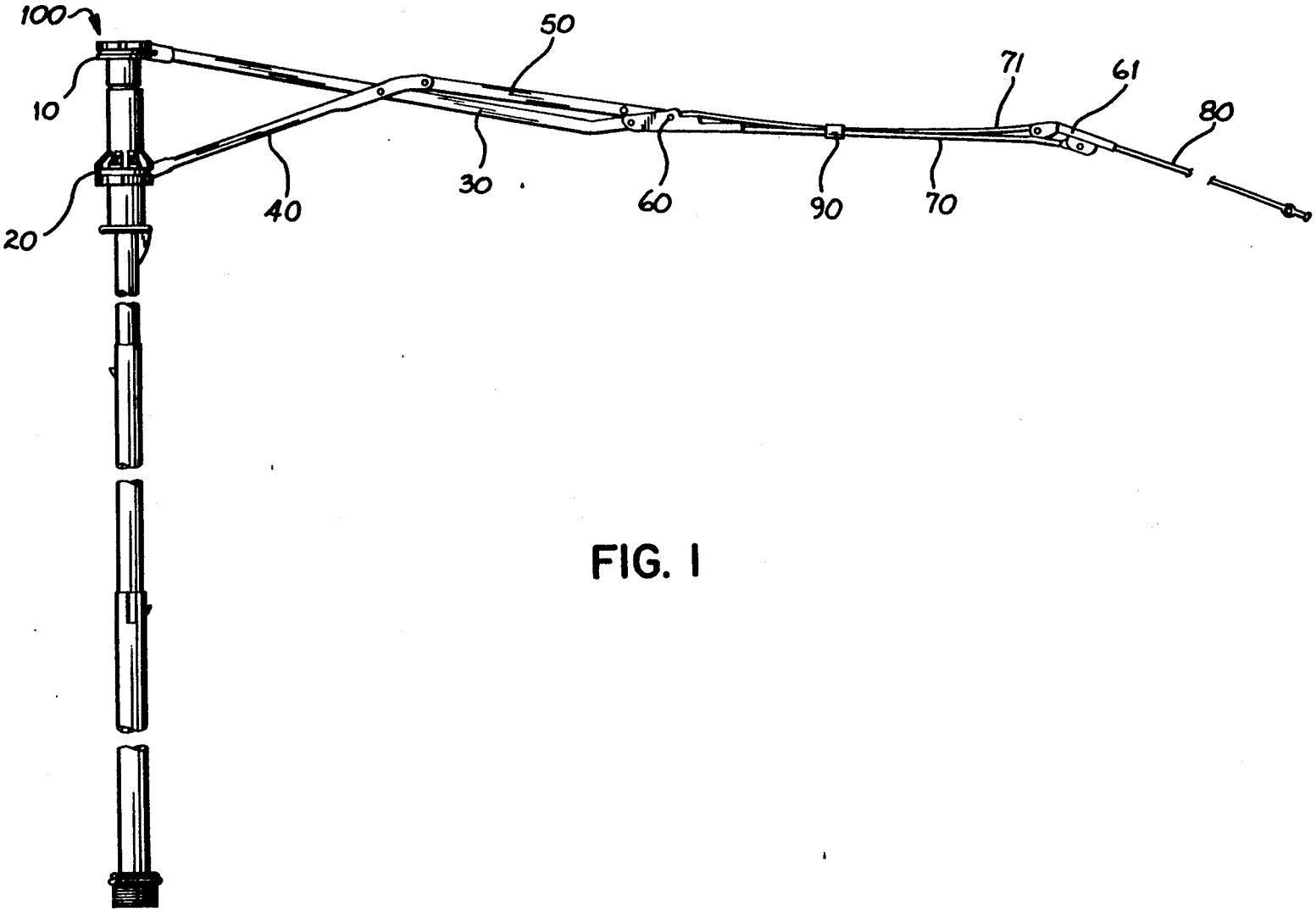
FIG. 1 is a plan view showing an umbrella with a rib linkage in the extended or open position.

An umbrella frame 100, as shown in FIG. 1, comprises a crown 10 fixed to one end of a centerpost, a slidable runner 20 carried on the centerpost, and a rib linkage attached between the crown and runner. The rib linkage includes inner rib 30 hingedly connected between the crown 10 and the middle joint 60, and inner linking spoke 50 hingedly connected between inner support rib 40 and the middle joint 60. The inner support rib 40 is pivoted between the runner 20 and the inner linking spoke 50, the inner rib 30 passing through the bifurcated end of the inner support rib 40 and being pivoted therewith. Middle rib 70 is fixed to the middle joint 60 and is hingedly connected to the outer joint 61. Flexible middle linking spoke 71 is connected between the inner linking spoke 50 and the outer joint 61. Outer rib 80 is also connected to the outer joint 16 and extends outwardly therefrom. Sleeve 90 holds the middle rib 70 and the flexible middle linking spoke 71 in assembled relation. This basic rib linkage structure is known to the prior art.

Figure 2:
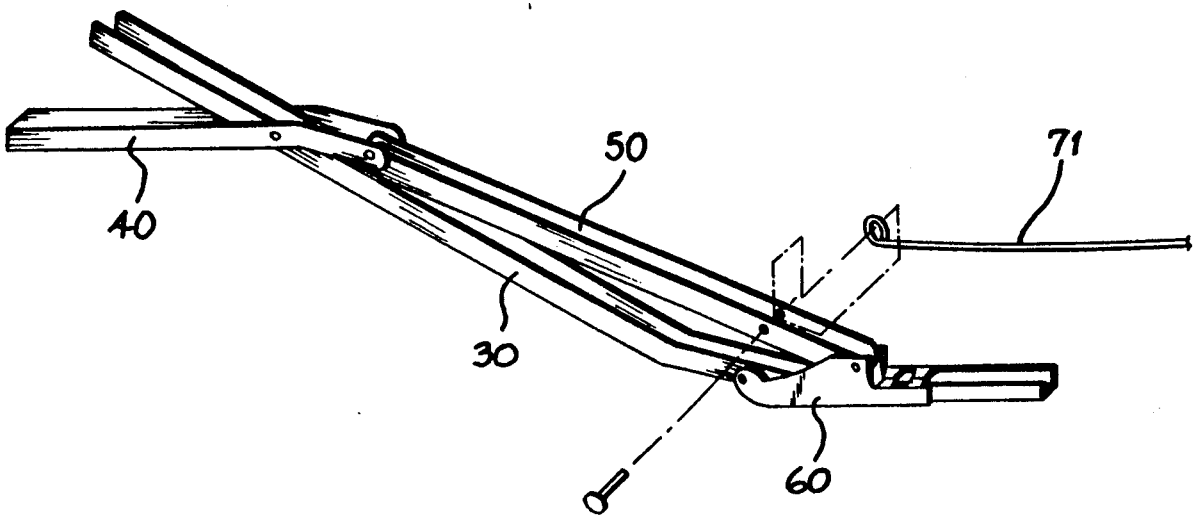
FIG. 2 is an enlarged exploded view showing a rib linkage joint in accord with the principles of this invention.
Figure 3:
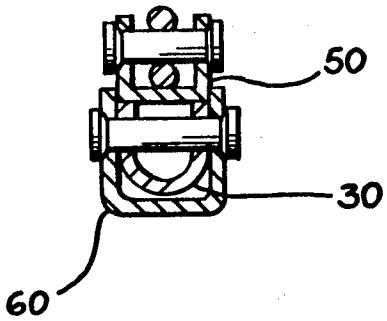
FIG. 3 is an enlarged cross-sectional view showing in assembled detail the rib linkage joint of FIG. 1.
Figure 4:
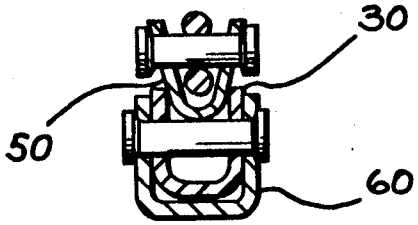
FIG. 4 is an enlarged cross-section view similar to FIG. 3 showing a second embodiment of the rib linkage joint.

In accord with this invention, the middle joint 60 has a U-shaped cross section with slot thereof facing upward. The inner rib 30 and the inner linking spoke 50 are struts, each having a U-shape with the slots thereof also facing upward. The inner linking spoke 50, inner rib 30, and middle joint 60 are sized so that the inner linking spoke 50 is guided by the middle joint 60 to seat against the inner rib 30 when the rib linkage is extended, as shown in FIG. 2. Specifically, the inner rib 30 and the inner linking spoke 50 are arranged such that the lower edge of the inner linking spoke 50 is seated on the upper edges of the inner rib 30 when the umbrella is stretched, as shown in the FIG. 3 embodiment. If the lower edge of the inner linking spoke 50 is formed in an arcuate shape, as shown in the alternate embodiment of FIG. 4, it seats against connection point of the inner rib 30 and the middle joint. In any case, this rib joint structure allows the inner linking spoke 50 to be located in the middle joint 60 without hang-up when the umbrella's rib linkage is extended or opened.

Note the slot of the inner linking spoke 50 faces upward so it is unnecessary to provide a hole in that spoke's floor for connection with the flexible middle linking spoke 71. Instead, a pin that is fixed between side walls of the inner linking spoke 50 is connected with the flexible middle linking spoke 71 through use of a looped end on that spoke 71. This allows easier manufacture and assembly of the umbrella rib linkage. This also creates a smoother top surface for the middle joint 60 over which the umbrella's cover will lay when the umbrella is opened, and also enhances the compactness of the rib linkage when it is collapsed or folded up.

Having described in detail the preferred embodiment of my invention, what I desire to claim and protect by Letters Patent is:

1. An improved rib linkage joint for an umbrella, said joint comprising an inner rib and an inner linking spoke both hingedly connected to a middle joint, said inner linking spoke having opposed side walls, a middle rib with one end, said middle joint being fixed to said one of said middle rib, each of said inner rib, inner linking spoke and middle joint having a U-shaped cross section with each said U-shaped cross section defining a slot that faces upward, said inner linking spoke being at least one of seated against and partially seated within said inner rib when said umbrella is opened, to linking spoke being at least one of seated against and partially seated within said inner rib when said umbrella is opened, to enhance wind resistance stability of said rib linkage joint, and a flexible middle linking spoke having one end connected to a pin fixed between said side walls of said inner linking spoke adjacent said middle joint, said rib linkage joint being of enhanced compact configuration because the slot of said inner linking spoke faces upward.

* * * * *